United States Patent [19]

Phillips, Sr.

[11] Patent Number: 4,995,301

[45] Date of Patent: Feb. 26, 1991

[54] TRI-MOTION GRINDING FIXTURE

[76] Inventor: Douglas B. Phillips, Sr., 4124 Greenleaf, Spring, Tex. 77389

[21] Appl. No.: 450,678

[22] Filed: Dec. 14, 1989

[51] Int. Cl.[5] ..... B24B 19/16

[52] U.S. Cl. ..... 51/219 R; 51/219 PC; 269/57; 269/69

[58] Field of Search ..... 269/55, 57, 58, 69; 51/95 LH, 218 A, 216 T, 216 ND, 216 H, 217 T, 217 A, 218 R, 218 T, 219 R, 219 PC

[56] References Cited

U.S. PATENT DOCUMENTS

| | | | |
|---|---|---|---|
| 2,607,172 | 8/1952 | Ruolle | 51/219 R |
| 2,672,714 | 3/1954 | Wilson | 51/219 R |
| 2,682,736 | 7/1954 | Cowi | 51/219 R |
| 2,701,432 | 2/1955 | Kent | 51/216 H |
| 2,797,533 | 7/1957 | Bluemink | 51/219 R |
| 3,298,681 | 1/1967 | Youngblood | 51/216 H |
| 3,571,982 | 3/1971 | Ramge | 51/219 R |
| 4,642,942 | 2/1987 | Gurhring | 51/219 PC |
| 4,860,497 | 8/1989 | Ohyu et al. | 51/219 PC |

*Primary Examiner*—Frederick R. Schmidt
*Assistant Examiner*—Blynn Shideler
*Attorney, Agent, or Firm*—Kenneth A. Roddy

[57] ABSTRACT

A fixture for holding and positioning reamers and other objects for grinding has a support base connectable to a flat horizontal surface and its upper portion is positioned at an angle relative to the horizontal surface. A cylindrical sleeve rotatably mounted on the upper portion of the support base has an eccentric longitudinal bore and a radial flange at its rearward end. A cylindrical spindle rotatably received within the eccentric bore has a mounting flange at its forward end to receive a chuck for holding an object to be ground and a rear flange adjacent the sleeve radial flange. A handle extending from the sleeve rotates the sleeve about its longitudinal axis. An axial guide flange between the support base and sleeve moves the sleeve forward or rearward upon rotation of the sleeve. A retractable rod connected between the spindle flange and sleeve flange selectively locks the spindle and sleeve together for rotation as a unit about the longitudinal sleeve axis or releases the spindle for rotating only the spindle about its longitudinal axis relative to the sleeve. The spindle rotates partially about the centerline of the sleeve when locked with the sleeve whereby the object being ground is eccentrically rotated in a radial spiral motion when the handle is pivoted. When the axial guide flange is angularly positioned the object being ground moves simultaneously forward or rearward and in a radial spiral motion. When the spindle and sleeve are unlocked the object being ground may be rotated only about its own longitudinal axis and positioned to grind subsequent surfaces.

14 Claims, 5 Drawing Sheets

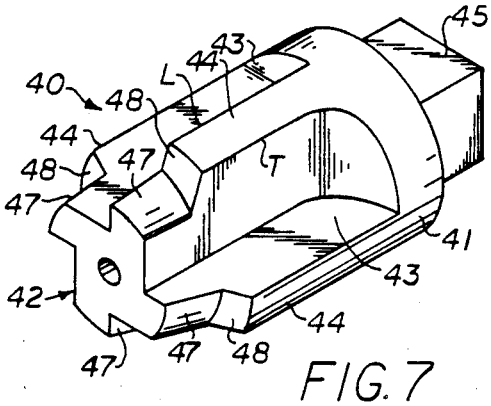
FIG. 7
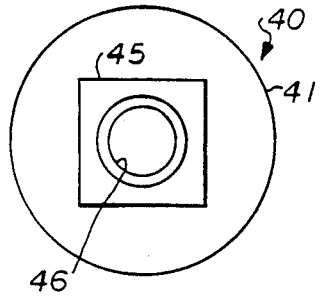
FIG. 10
FIG. 9
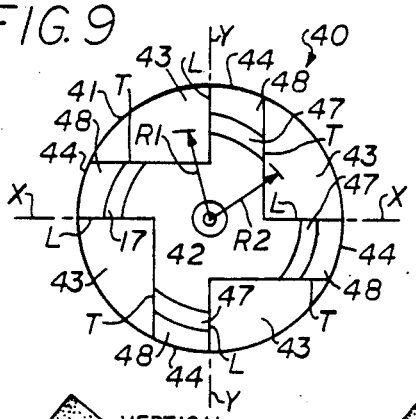
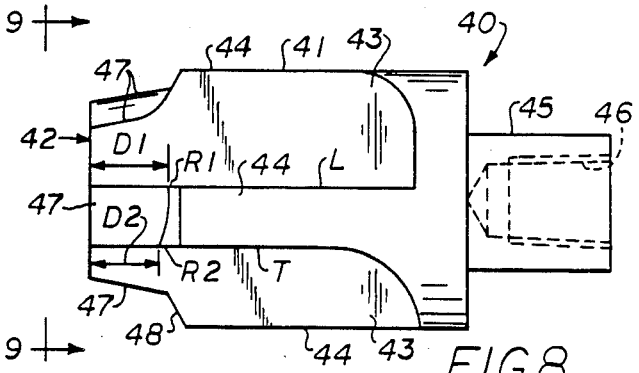
FIG. 8
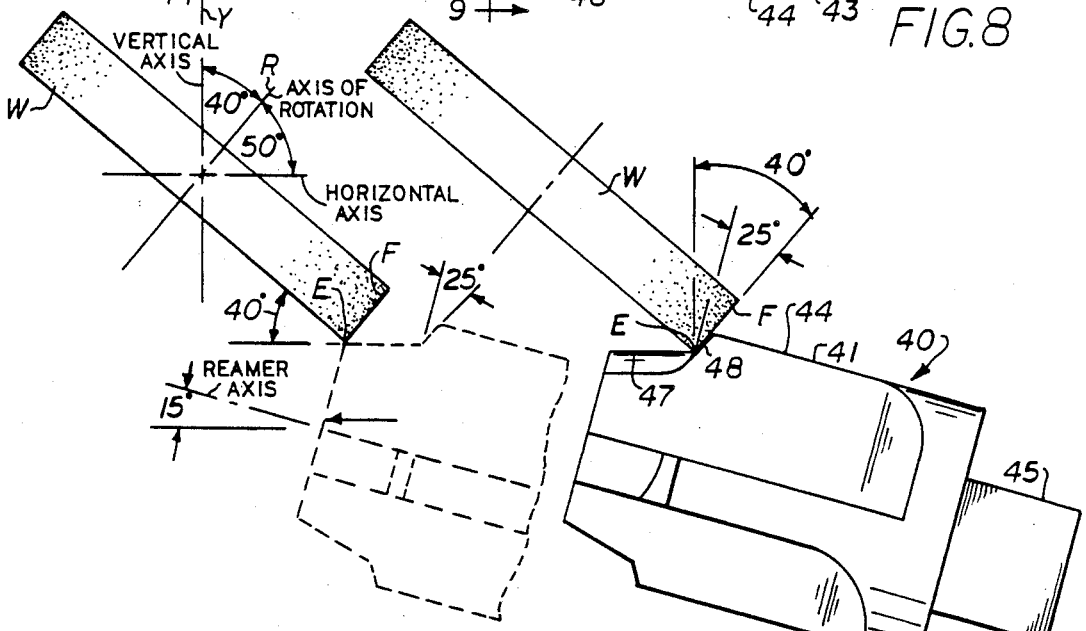
FIG. 11

TRI-MOTION GRINDING FIXTURE

BACKGROUND OF THE INVENTION

1. Field of the Invention

This invention relates generally to grinding fixtures, and more particularly to a grinding fixture capable of selectively moving a workpiece forward and rearward relative to a grinding wheel while simultaneously rotating it eccentrically, and of rotating the workpiece concentrically to grind predetermined angular and curved surfaces.

2. Brief Description of the Prior Art

The grinding or re-working of drill bits, taps, reamers, etc., requires accurate and uniform grinding of the multiple angular and curved surfaces. Some tools, such as reamers, are fluted to define wings, and require exceedingly careful treatment to avoid accidental grinding of adjacent surfaces while producing a proper conical reaming configuration and clearance behind the leading edge of each wing portion. There are several patents disclosing grinding fixtures which have been designed to produce various angular and curved surfaces on drill bits, taps, reamers, etc.

Wilson, U.S. Pat. No. 2,672,714 discloses a fixture having a V-block and a cylindrical barrel resting in the V-block and having a flange at one end to engage the end of the V-block. The barrel is rotated while in tangential contact with the V-surfaces and has an eccentric bore. A tool holding sleeve is slidably and rotatably mounted in the eccentric bore and has a flange at one end. The barrel flange has a series of circumferentially spaced indexing holes and the sleeve flange is provided with an indexing pin which will engage selective ones of the indexing holes. The sleeve may be withdrawn partially from the barrel, rotated, and returned to a plurality of angular positions.

Detrow, U.S. Pat. No. 2,700,854 discloses tap grinding fixture having a support base with a vertically extending bracket revolvably mounted thereon and which terminates in a circular head. Another bracket having a coacting circular head is revolvably connected to the first circular head and has a forwardly extending portion disposed off center from the circular head and terminating in a ring member. A cylindrical body structure having an end flange is adjustably secured to the ring member. The body structure has a longitudinally extending bore therethrough with a cylindrical tube assembly mounted in the bore. The cylindrical tube assembly includes a pair of coacting inner and outer eccentric sleeves adjustable one with respect to another. A chuck spindle is carried by the inner sleeve and projects beyond opposite ends of the sleeves. An actuating disc is mounted on the outer sleeve adjacent the end of the body structure and an indexing plate is mounted on the spindle adjacent the actuating disc. An actuating lever extends outwardly from the actuating disc for controlling the movement of the chuck spindle in an orbital path. A number of indexing plates must be installed for various different taps according to the number of their flutes.

Studler, U.S. Pat. No. 2,797,538 discloses a grinding tool having a fixed casing with a spindle received in a bore in the casing. The spindle has a chuck at the forward end and a bushing is disposed at the rear of the casing bore to guide the spindle. The rear end of the spindle extends beyond the bushing. The spindle has a cam face on its forward side toward the bushing. A double faced cam collar is mounted on the spindle and cooperates with a cam follower arm carrying a ball. When the spindle rotates continuously in one direction, the cam faces ride up on the ball to move the tool toward and against the grinding wheel under spring pressure.

Farnsworth, U.S. Pat. No. 3,090,633 discloses an index mechanism for a chuck having a housing and a spindle assembly rotatably mounted in the housing which grips the workpiece for rotation therewith. The indexing mechanism comprises a cylindrical member secured to the spindle assembly and a series of balls fixed circumferentially around the cylindrical member with adjacent balls abutting against one another to form a V-shaped space between each pair of balls. A plunger shiftably mounted on the housing has a portion insertable into the space between the balls to prevent rotation of the spindle assembly relative to the housing.

Zapart, U.S. Pat. No. 4,100,702 discloses an indexing fixture comprising a generally rectangular rigid upstanding housing having a longitudinal bore. A fixed cylindrical hollow tubular member is secured in the bore and has a rear flange engaging the rearward wall of the housing. A hollow tubular spindle is slip fitted in the fixed tubular member and has a front flange positioned forwardly of the housing front wall. A toothed indexing wheel is secured to the rearward portion of the spindle. A collet-receiving manipulating ring is loosely keyed to the indexing wheel and rotates freely thereon. A rotatable indexer member extends down through the top of the housing to be moved into the rotary path of the indexing wheel. A detent is disposed adjacent the front flange to be moved into engagement with a dog mounted on the front flange.

Bernard et al, U.S. Pat. No. 4,485,596 discloses a drill chuck supporting cradle which is mounted for limited rotation on a tiltable cross feed table. The cradle is provided with a band or bridge affixed at one side of the cradle and attached at the other side by an eccentric so that the band can be tightened to hold a chuck in fixed relation to the cradle. The cross feed table is supported by a standard which has a pair of stop pins which limit the pivotal movement of the table.

Zapart, U.S. Pat. No. 3,887,202 discloses a grinding fixture which has a rotatable workpiece-holding spindle which may be indexed at any selected angular division of a circle. The device utilizes at least two circumferentially spaced indexers radially insertable into and retractable from interspaces between adjacent teeth spaced at ten degree intervals around the circumferential face of an associated rotatable spindle.

The present invention is distinguished over the prior art in general, and these patents in particular by a fixture for holding and positioning reamers and other objects for grinding which has a support base connectable to a flat horizontal surface and its upper portion is positioned at an angle relative to the horizontal surface. A cylindrical sleeve rotatably mounted on the upper portion of the support base has an eccentric longitudinal bore and a radial flange at its rearward end. A cylindrical spindle rotatably received within the eccentric bore has a mounting flange at its forward end to receive a chuck for holding an object to be ground and a rear flange adjacent the sleeve radial flange. A handle extending from the sleeve rotates the sleeve about its longitudinal axis. An axial guide flange between the support base and sleeve moves the sleeve forward or rearward upon rotation of the sleeve. A retractable rod connected between the spindle flange and sleeve flange selectively locks the spindle and sleeve together for rotation as a unit about the longitudinal sleeve axis or releases the spindle for rotating only the spindle about its longitudinal axis relative to the sleeve.

The spindle rotates partially about the centerline of the sleeve when locked with the sleeve whereby the object being ground is eccentrically rotated in a radial spiral motion when the handle is pivoted. When the axial guide flange is angularly positioned the object being ground moves simultaneously forward or rearward and in a radial spiral motion. When the spindle and sleeve are unlocked the object being ground may be rotated only about its own longitudinal axis and positioned to grind subsequent surfaces.

SUMMARY OF THE INVENTION

It is therefore an object of the present invention to provide a tri-motion grinding fixture capable of selectively moving a workpiece forward and rearward relative to a grinding wheel while simultaneously rotating it eccentrically, and of rotating the workpiece concentrically to grind predetermined angular and curved surfaces.

It is another object of this invention to provide a tri-motion grinding fixture which will hold a workpiece at a proper angle relative to a grinding face for grinding surfaces relative to the axis of the workpiece.

Another object of this invention is to provide a tri-motion grinding fixture which will rotate a workpiece relative to a grinding face for grinding curved and angular surfaces on the workpiece.

Another object of this invention is to provide a tri-motion grinding fixture which will eccentrically rotate a workpiece relative to a grinding face for grinding curved clearance surfaces on the workpiece.

Another object of this invention is to provide a tri-motion grinding fixture having an indexing feature whereby multiple curved and angular surfaces will be ground alike and centered relative to the axis of the workpiece.

A further object of this invention is to provide a tri-motion grinding fixture which does not require time consuming resetting or readjustment between positioning and grinding multiple surfaces.

A still further object of this invention is to provide a tri-motion grinding fixture which is simple in construction, economical to manufacture, and accurate and reliable in operation.

Other objects of the invention will become apparent from time to time throughout the specification and claims as hereinafter related.

The above noted objects and other objects of the invention are accomplished by a fixture for holding and positioning reamers and other objects for grinding which has a support base connectable to a flat horizontal surface and its upper portion is positioned at an angle relative to the horizontal surface. A cylindrical sleeve rotatably mounted on the upper portion of the support base has an eccentric longitudinal bore and a radial flange at its rearward end. A cylindrical spindle rotatably received within the eccentric bore has a mounting flange at its forward end to receive a chuck for holding an object to be ground and a rear flange adjacent the sleeve radial flange. A handle extending from the sleeve rotates the sleeve about its longitudinal axis. An axial guide flange between the support base and sleeve moves the sleeve forward or rearward upon rotation of the sleeve. A retractable rod connected between the spindle flange and sleeve flange selectively locks the spindle and sleeve together for rotation as a unit about the longitudinal sleeve axis or releases the spindle for rotating only the spindle about its longitudinal axis relative to the sleeve.

The spindle rotates partially about the centerline of the sleeve when locked with the sleeve whereby the object being ground is eccentrically rotated in a radial spiral motion when the handle is pivoted. When the axial guide flange is angularly positioned the object being ground moves simultaneously forward or rearward and in a radial spiral motion. When the spindle and sleeve are unlocked the object being ground may be rotated only about its own longitudinal axis and positioned to grind subsequent surfaces.

BRIEF DESCRIPTION OF THE DRAWINGS

FIG. 7 is an isometric view of a reamer of the type having surfaces ground by the tri-motion grinding fixture.

FIG. 8 is a side elevation of the reamer of FIG. 1.

FIG. 9 is a front elevation of the reamer of FIG. 1.

FIG. 10 is a rear elevation of the reamer of FIG. 1.

FIG. 11 is a side elevation of the reamer tilted at an angle and being fed horizontally into the grinding wheel.

DESCRIPTION OF THE PREFERRED EMBODIMENT

Figure 2:
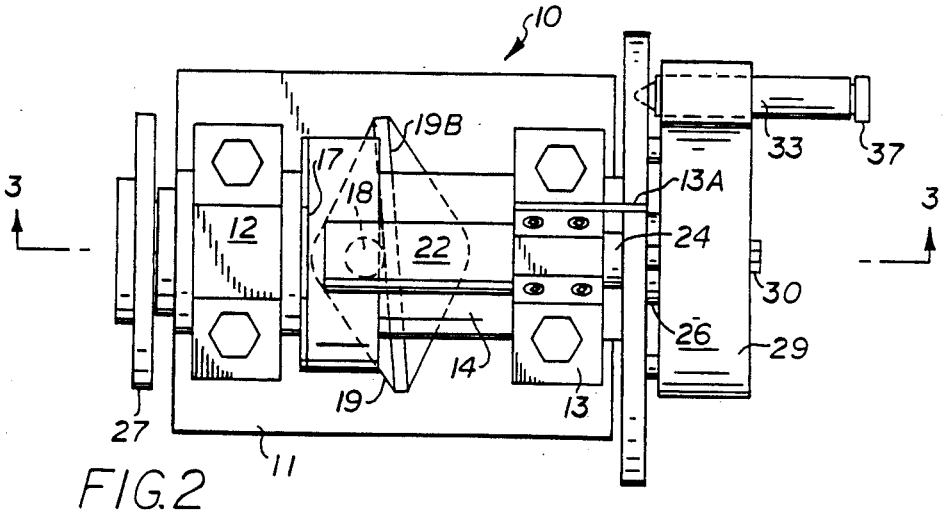
FIG. 2 is a top plan view of the tri-motion grinding fixture of FIG. 1.
Figure 1:
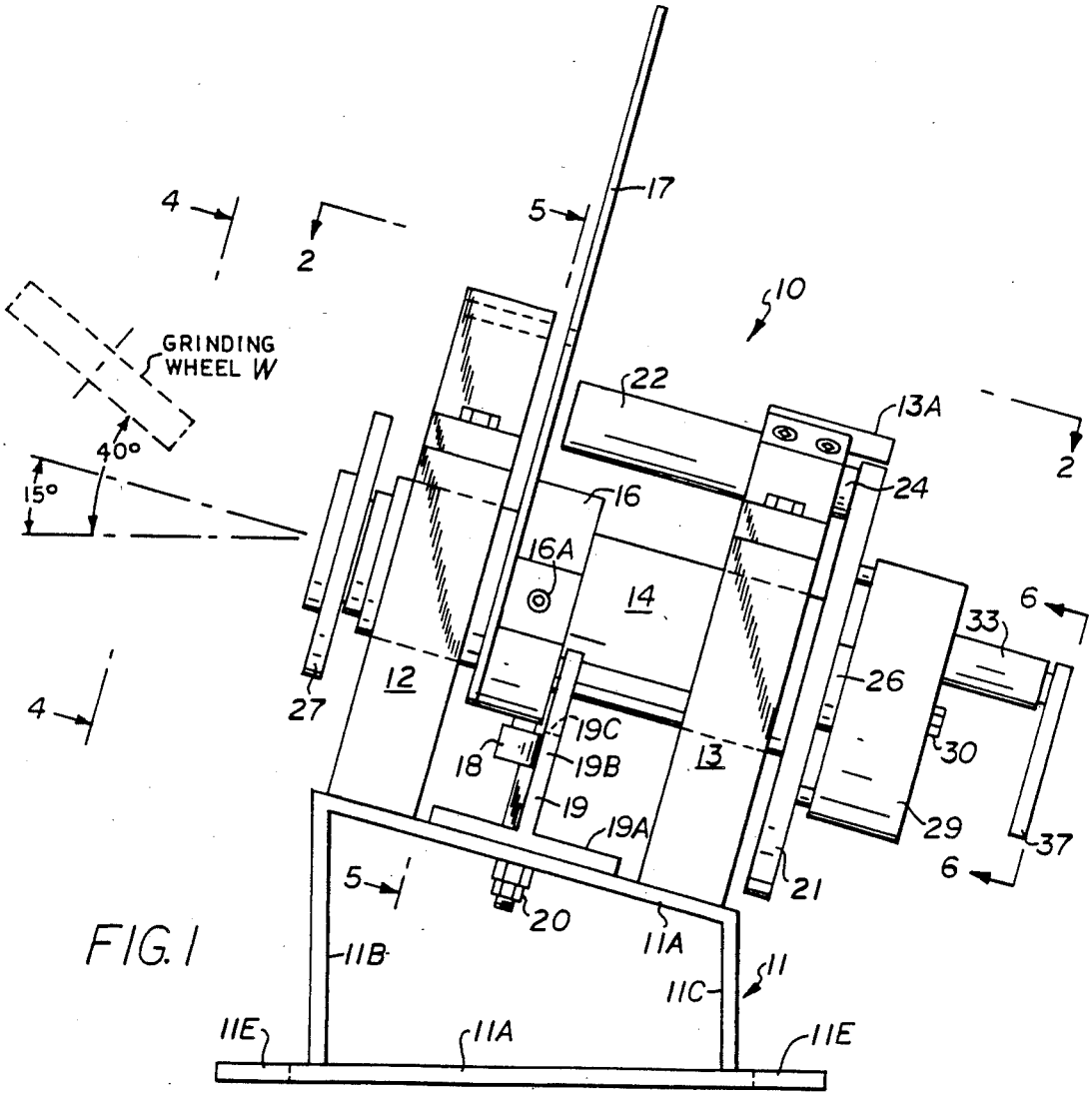
FIG. 1 is a side elevation of a tri-motion grinding fixture in accordance with the present invention.
Figure 3:
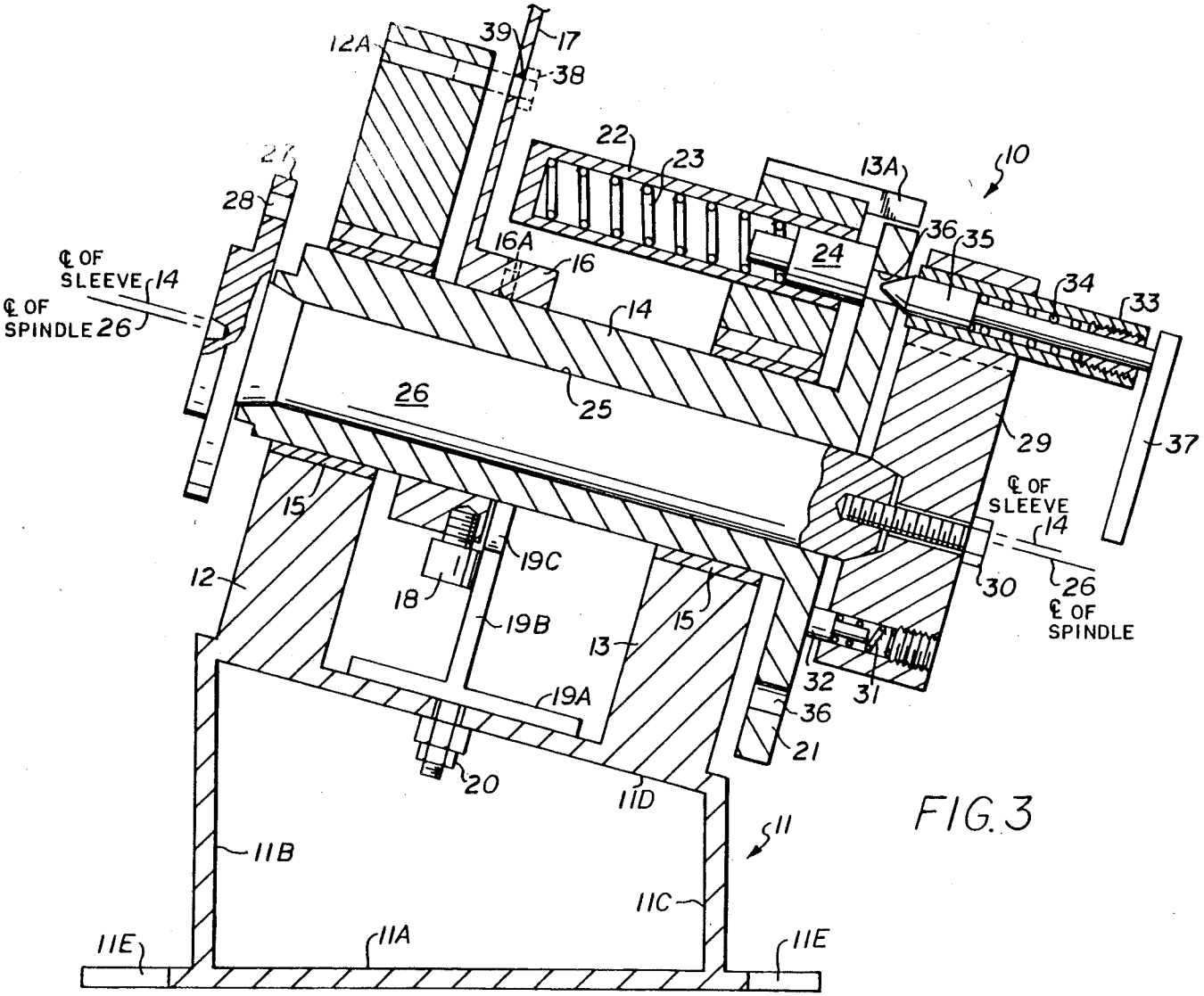
FIG. 3 is a longitudinal cross section through the tri-motion grinding fixture taken along line 3—3 of FIG. 1.
Figure 6:
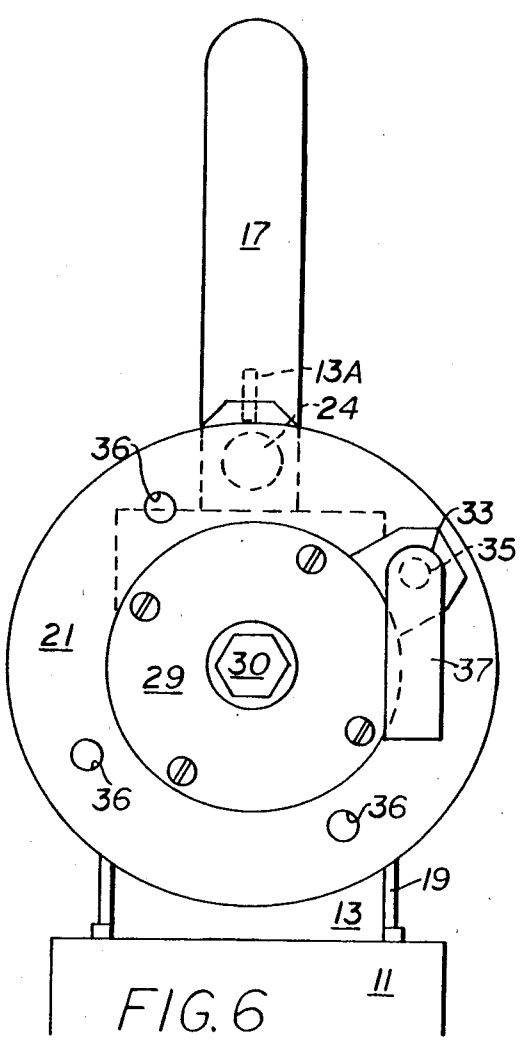
FIG. 6 is a rear elevation of the tri-motion grinding fixture taken along line 6—6 of FIG. 1.

Referring to the drawings by numerals of reference, and particularly to FIGS. 1, 2, and 3, there is shown a preferred tri-motion grinding fixture 10. The grinding fixture 10 has a support base 11. The support base 11 comprises a flat bottom plate 11*a*, a pair of rectangular upright end plate members 11*b* and 11*c*, and a rectangular top plate 11*d* extending between the end plates 11*b* and 11*c*. The bottom plate 11*a* is provided with a pair of slots 11*e* at each end for bolting the base 11 to the bed of a universal grinding machine. The forward end plate 11*b* is of greater height than the rearward end plate 11*c* which positions the longitudinal axis of the grinding fixture 10 at an angle relative to the horizontal surface of the universal grinding machine bed. The grinding fixture 10 will move horizontally with the bed of the grinding machine as a unit relative to a rotating grinding wheel W.

Commercially available adjustable angle mounting hardware such as an angle plate or shim stock may be utilized in place of the illustrated fixed angle support base 11 whereby the angle of the longitudinal axis of the fixture relative to the grinding machine bed may be selectively adjusted. The top plate 11*d* may be also be hingedly connected to the rearward end plate 11*c* and have a depending rectangular plate at its forward end which slidably overlaps the forward end plate 11*b* with slots the depending plate whereby inclination of the top plate 11*d* may be adjusted and secured at selected angles by a wing nut extending through the slot and threadedly received in a hole provided in the forward end plate (not shown).

As best seen in FIG. 3, a pair of upstanding rectangular mounting blocks 12 and 13 are secured to the top plate 11*d* at each end of the base 11. A central cylindrical sleeve 14 is rotatably journaled between the blocks 12 and 13 by bearings 15 at each end. A collar 16 is secured by set screws 16*a* onto the sleeve 14 behind the block 12 and has a handle 17 extending outwardly from the top for rotating the sleeve 14 relative to the blocks 12 and 13. A roller 18 is rotatably and slidably mounted on the bottom exterior of the collar 16.

An upstanding guide flange 19 is adjustably mounted on the top plate 11*d* beneath the sleeve 14. The guide flange 19 has a bottom plate 19*a* and an upstanding portion 19*b* perpendicular thereto with a semi-circular cut-out portion 19*c* at the top to clear the bottom surface of the sleeve 14. The upstanding portion 11*b* of the guide flange 19 extends transversly across the base 11 and the bottom plate 19*a* is rotatably adjusted and secured by bolt 20 to the top plate 11*d*. The upstanding portion 19*b* of the guide flange 19 is engaged with the roller 18, and can be positioned angularly transverse relative to the longitudinal axis of the sleeve 14 (FIG. 2). Thus when the handle 17 is pivoted, the sleeve 14 will rotate about its longitudinal axis and the roller 18 rolling across the angularly transverse positioned upright portion 19*b* of the guide flange 19 causes the sleeve 14 to move forward or rearward along its longitudinal axis as it rotates.

The sleeve 14 has a radial flange portion 21 at its rearward end. A tubular housing 22 is secured in the top of the block 13 and contains a compression spring 23 which urges a nylon pad 24 outwardly against the face of the radial flange portion 21 of the sleeve 14. Thus the roller 18 is always spring biased against the guide flange 19. Changing the angle of the guide flange 19 determines the amount of forward and rearward travel of the sleeve 14 as the handle 17 pivots.

The sleeve 14 has a longitudinal bore 25 which is eccentrically offset from the centerline of the sleeve. A cylindrical shaft or spindle 26 is rotatably received within the sleeve bore 25 and has a flange 27 at the forward end which has a series of circumferentially spaced holes 28 therein for mounting a conventional work-holding device such as a collet chuck (not shown) to the fixture. The work-holding device or collet chuck holds the reamer or other object to be ground. A flange 29 is releasably secured by a bolt 30 to the rear end of the shaft or spindle 26 and rotates therewith. The bolt 30 may be loosened to selectively position the spindle 26 as explained hereinafter.

A series of compression springs 31 are contained within circumferentially spaced holes 29*a* in the flange 29 which urge nylon pads 32 outwardly against the rear surface of the radial flange portion 21 of the sleeve 14. Thus the shaft or spindle 26 is always spring biased within the sleeve 14 to insure close tolerance even after wear occurs. When the handle 17 is pivoted, the sleeve 14 rotates while moving forward or rearward and carries the shaft or spindle 26 with it.

Figure 5:
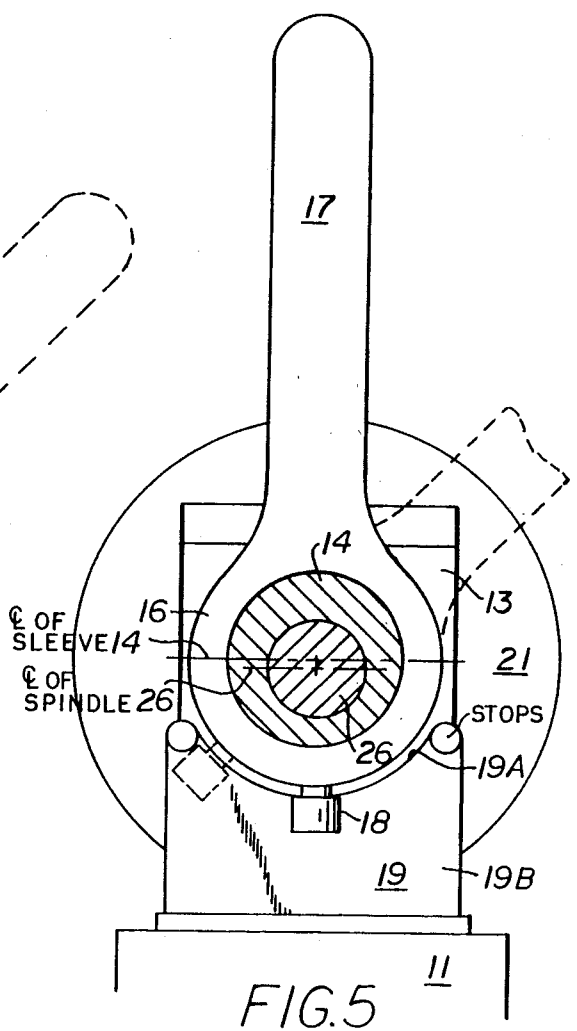
FIG. 5 is a transverse cross section of the tri-motion grinding fixture taken along line 5—5 of FIG. 1.
Figure 4:
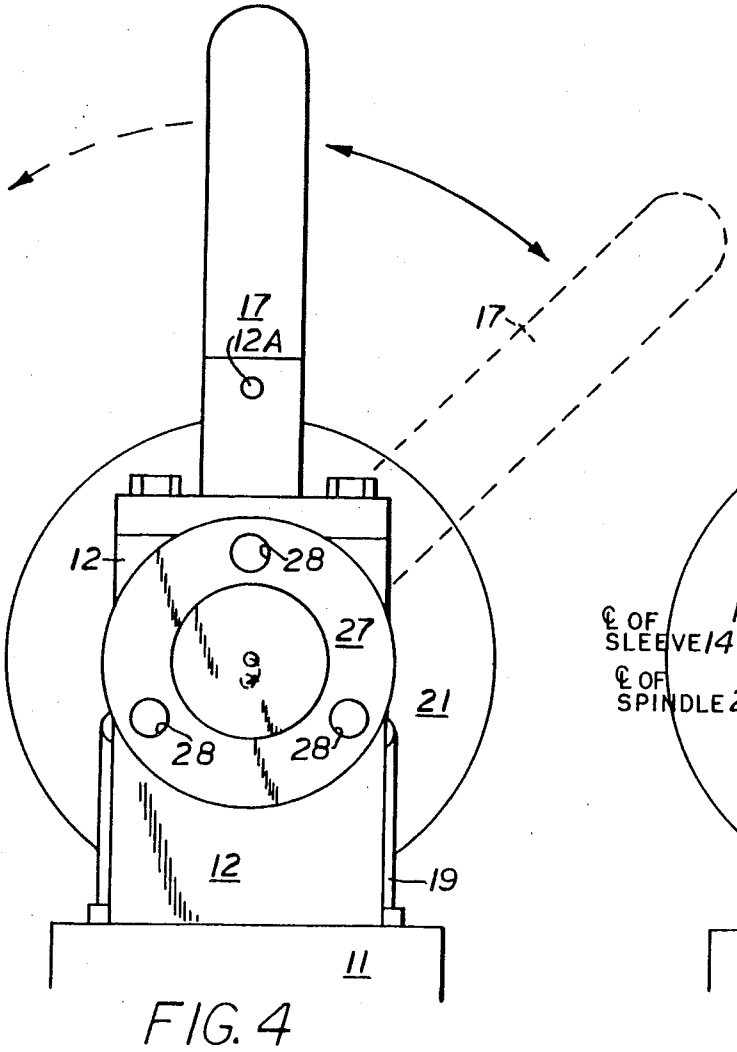
FIG. 4 is a front elevation of the tri-motion grinding fixture taken along line 4—4 of FIG. 1.
Figure 12:
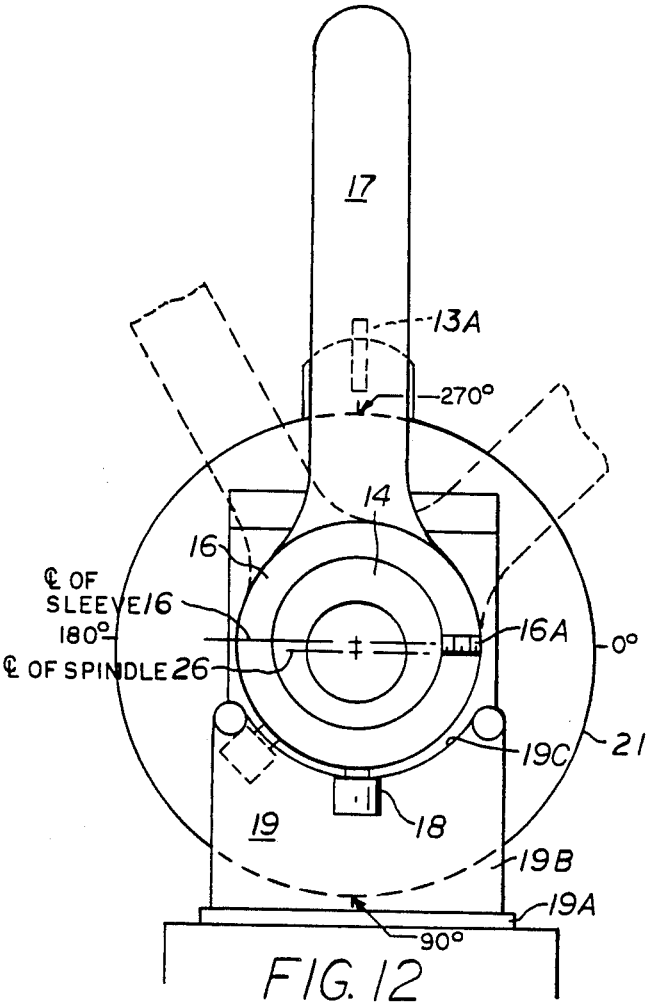
FIG. 12 is a transverse cross section of the tri-motion grinding fixture similar to FIG. 5 illustrating the adjustment of the angular relationship of the handle relative to the sleeve.

Since the shaft 26 is eccentrically mounted in the sleeve 14, the longitudinal axis (center line) of the shaft 26 will rotate partially about the centerline of the sleeve 14 (FIGS. 4 and 5). The work-holding device mounted on the flange 27 of the shaft 26 is thus eccentrically rotated when the handle 17 is pivoted resulting in a radial generally up and down motion. When the guide flange 19 is angularly positioned with the roller 18 engaged thereon, the work-holding device will move forward or rearward in a radial generally up and down motion as the handle 17 is pivoted.

The eccentric position of the spindle 26 may also be fixed relative to the sleeve 14. A tubular housing 33 is secured on the flange 29 and contains a compression spring 34 which urges a pointed rod 35 outwardly against the rear surface of the radial flange portion 21 of the sleeve 14. One of a series of circumferentially spaced holes 36 in the flange portion 21 receives the pointed end of the rod 35 to latch the flanges together. A hand grip 37 is secured at the other end of the rod 35 for moving it in and out of engagement. Thus, the eccentric position of the shaft or spindle 26 relative to the sleeve 14 may be fixed by inserting the rod 35 into one of the holes 36. The flange 21 or holes 36 may have markings or indicia associated therewith for indicating there relative angular relationship. An index marker 13*a* may be attached to overhang the flange portion 21 of the sleeve and the flange portion 21 of the sleeve 14 may be provided with markings or calibrations corresponding to settings for 0°, 90°, 180°, and 270°. The maximum amount of eccentricity between the spindle 26 and the sleeve 14 being when handle 17 is in the vertical position and the 270° degree mark on the flange portion 21 is aligned with index marker 13*a*.

When the pointed end of the rod 35 is engaged within a hole 36, the sleeve 14 and shaft 26 are rotated as a unit by turning the handle 17 (rotating the flange portion 21 of the sleeve 14). Alternatively, the handle 17 may be pinned to the forward block 12 by placing a bolt 38 through hole 39 in handle and hole 12*a* in block 12 (FIG. 3).

When so pinned, the sleeve 14 cannot rotate or move forward or rearward. With the handle 17 in the pinned position, the rod 35 may be retracted from the hole 36 and the flange 29 rotated using the tubular member 33 as a crank to rotate only the spindle 26 relative to the sleeve 14. Since the sleeve 14 is fixed, the shaft 26 will rotate only concentrically about its own longitudinal axis. Thus the work-holding device may be rotated concentrically while positioned eccentrically within the sleeve 14 for grinding cylindrical surfaces.

It should be noted that the flange 29 at the back of the spindle 26 performs several functions. The work-holding device at the forward end of the spindle 26 may be indexed, or rotated about its longitudinal axis without changing the eccentric relationship between the spindle 26 and sleeve 14 or any of the other settings except for turning the spindle 26 and securing it to the sleeve 14 whereby they both turn on bearings 15. This is accomplished by pulling out on the hand grip 37 and releasing the pointed rod 35 to engage the next hole 36 in the flange 21.

The workpiece being ground is brought into proper grinding position in relation to the center of the grinding wheel W, or "zeroed in" by loosening bolt 30 at the back end of the spindle 26 and turning the spindle until the workpiece being ground is in the desired position then bolt 30 is tightened.

When grinding cylindrical shapes, the handle 17 is secured to the mounting block 12 by passing the bolt 38 through the handle into the hole 12*a* in the mounting block 12. The flange 21 and sleeve 14 may then be disengaged from the spindle 26 by pulling out on the hand grip 37 and holding it out while turning the flange 29 to rotate only the spindle 26 about its longitudinal axis. In this position, all other settings are non-functional.

The structural features of the grinding fixture 10 cooperate to grind conical surfaces on the forward end of reamers and the like. The grinding fixture 10 is particularly suited to grinding a reamer of the type described in applicant's pending U.S. patent application, Ser. No. 259,893, and described below with reference to FIGS. 7–10.

In order to describe the operation of the grinding fixture 10, a description of the finished structural features of a finished chamfering reamer product 40 will be undertaken followed by a description of how the grinding fixture produces these structural features.

As shown in FIGS. 7–10, the chamfering reamer 40, or inside diameter reamer, is configured to ream the inside diameter of pipe or conduit. The reamer 40 comprises a generally cylindrical body 41 having a truncated conical forward end 42 and a plurality of longitudinal recesses or flutes 43 extending rearwardly from the front end defining a plurality of circumferentially spaced longitudinal wings 44. The rear end of the body 41 is a square configuration or tailpiece 45 having internal threads 46 for mounting it in a conventional threading machine.

The exterior of each wing 44 tapers rearwardly and outwardly at an angle relative to the longitudinal axis to form a generally conical reaming portion 47 of smaller diameter than the outer surface of the wings 44. A conical shoulder 48 extends rearwardly and outwardly from the back end of the conical reaming portion 47 to the outer surface of each wing 44 to form a tripping shoulder therebetween. The conical reaming portion 47 preferably slopes at an angle of from 10° to 15° relative to the longitudinal axis, and the conical tripping shoulder 48 slopes at an angle greater than the conical reaming portion 47, preferably at an angle of from 20° to 30° relative to the vertical axis of the reamer.

The relative angles of the conical reaming portion 47 and the tripping shoulder 48 are such that the forward end of the truncated conical reaming portion 47 will be received within the end of a pipe or conduit and will chamfer the interior diameter at the end of the pipe or conduit as the pipe or conduit is fed onto the reamer 40 without touching the external threads. Continued feeding of the pipe or conduit causes its interior diameter to forceably contact the conical surface 47 at its approximate transition with the tripping shoulder 48 to activate a chaser holder which will release the chamfered piece. The angle of the tripping shoulder 48 provides clearance to prevent the shoulder from engaging the end surface of the pipe or conduit being reamed.

As seen in FIGS. 7–10, the preferred reamer has four flutes 43 forming four opposed wings 44, although some sizes may have anywhere from two to six flutes and wings. The wings 44 including the conical reaming portions 47 are offset laterally from the horizontal and vertical axes X and Y. When viewed from the front end (FIG. 9), opposing wings including the conical reaming portion and shoulder portion end each have diametrically opposed flat leading edge surfaces L and flat trailing edge surfaces T spaced generally parallel thereto in a clockwise direction from the leading edge surface. The curve of the reaming portion 47 including the transition point between the conical reaming portion 47 and trip shoulder 48 is formed such that the leading edge L has a larger radius r1 and terminates at the clockwise trailing edge T with a smaller radius r2. In other words, the conical surface of the reaming portion 47 is spiraled radially inward from the leading edge L to the trailing edge T.

As seen from the side (FIG. 8), the spiraled curved surface extending from r1 to r2 also extends rearward from a longer distance d1 to a shorter distance d2 from the front surface of the conical portion. Thus the clockwise trailing edge surface T of the conical reaming portion 47 and trip shoulder 48 is radially smaller than the leading edge L and the transition between the angular surfaces is closer to the front of the reamer at the trailing edge T than at the leading edge L.

As the pipe or conduit continues to be fed onto the conical reaming portion 47, the interior diameter will contact the inwardly spiraled surface of the reaming portion somewhere near the trailing edge T since the transition point at r2 is closer to the front at the trailing edge.

OPERATION

The semi-finished reamer 40, including the flutes 43, wings 43, tailpiece 45, reaming portion 47, and shoulder 48 are machined from round stock to rough, or semi-finished, dimensions by conventional machinery and methods and the reamer is finished by grinding with the present grinding fixture. The operator first sets the rotational axis of the grinding wheel at approximately 40° to vertical or 50° to horizontal. A collet chuck is mounted on the spindle flange 27 of the fixture 10. The rough reamer 40 is secured by its square tailpiece 45 in the collet chuck. The support base 11 of the fixture 10 is secured onto the horizontally movable bed of the grinding machine. The top plate 11*a* of the fixture 10 is adjusted to place the top plate (and longitudinal axis of the reamer) at the desired angle for grinding the reaming portion 47 of the wings 44. In grinding the reamer 40, the top plate 11*a* is set at an angle of 10° to 15° relative to horizontal, thus placing the longitudinal axis of the sleeve 14 and spindle 26 parallel to the 10° to 15° angle.

Referring now to FIG. 11, with the rotational axis R of the grinding wheel W set at 40° to vertical or 50° to horizontal, the outside diameter or grinding face F of the wheel W will also be at 40° to vertical or 50° to horizontal. If the longitudinal axis of the reamer 40 (also sleeve 14 and spindle 26) is set at approximately 15° to horizontal, and if the reamer 40 is fed horizontally by the bed of the grinding machine into grinding wheel, the lower edge E of the grinding wheel face F will grind the reaming portion 47 at a 0° angle to horizontal or a 15° angle relative to the longitudinal axis of the reamer 40 since it is tilted at 15°. When the grinding face F of the wheel W contacts the shoulder 48 it will grind the shoulder to a 40° angle relative to vertical or 25° relative to the longitudinal axis of the reamer (40°−15°=25°).

Referring now to FIGS. 11, 12, 13, and 14, the semi-finished reamer 40 to be ground is "zeroed in" or brought into proper grinding position in relation to the center axis or axis of rotation R of the grinding wheel W by loosening bolt 30 at the back end of the spindle 26 and turning the spindle until the flat leading edge L of the uppermost wing 44 of the semifinished reamer 40 is vertically aligned with the axis of rotation R of the grinding wheel W and then bolt 30 is tightened.

FORWARD AND REARWARD MOTION

The forward and rearward motion of the reamer 40 parallel to the longitudinal axis of the sleeve 14 is adjusted by setting the angle of the upstanding portion 19*b* of the guide plate 19 transverse to the top plate 11*a*. The roller 18 riding on the surface 19*b* of the guide plate 19 as the handle 17 is pivoted causes the forward and rearward motion to operate simultaneously with the "spiral motion" described below to grind the non-cutting trip shoulder 48 of the reamer 40.

Figure 13:
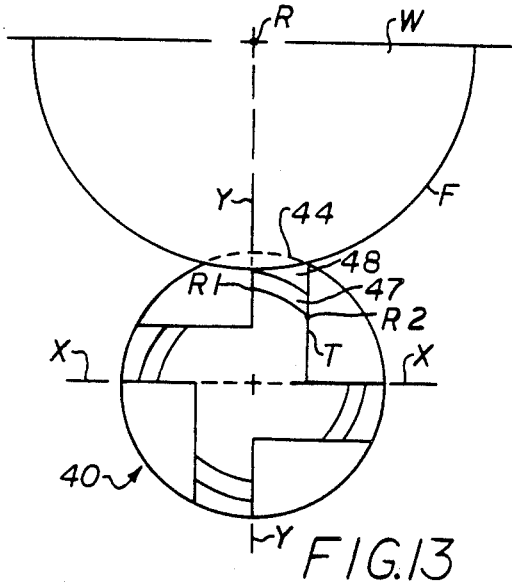
FIG. 13 is a front elevation of the reamer having its leading edge in alignment with the axis of rotation of the grinding wheel at the beginning of the grinding operation.
Figure 14:
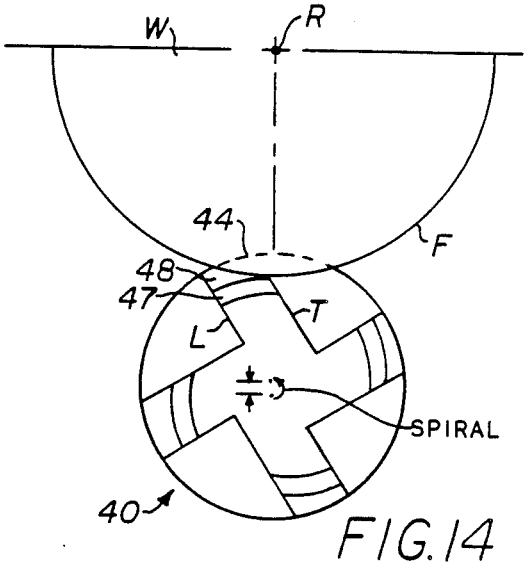
FIG. 14 is a front elevation of the reamer after being eccentrically rotated during the grinding operation.

As shown in FIGS. 13 and 14 and previously described with reference to FIGS. 7–10, the wings 44 when viewed from the front are offset laterally from the horizontal and vertical axes X and Y and each has a flat leading edge surface L and a flat trailing edge surface T. The curve of the reaming portion 47 including the transition point between the conical reaming portion 47 and trip shoulder 48 is formed such that the leading edge L has a larger radius r1 and terminates at the clockwise trailing edge T with a smaller radius r2. In other words, the conical surface of the reaming portion 47 is spiraled radially inward from the leading edge L to the trailing edge T.

SPIRAL MOTION

The inwardly spiraled reaming portion 47 which extends between the leading edge L and the trailing edge T is formed by an up and down or "spiral movement" of the reamer 40 as it is being ground and rotated or "rocked back and forth" by the handle 17. Thus to achieve this motion the spindle 26 must be offset eccentrically to the sleeve 14, otherwise, a purely cylindrical surface would result. As shown somewhat schematically in FIG. 12, the amount of "up and down" or eccentricity is controlled by adjusting the angular relationship of the handle 17 relative to the sleeve 14. The set screws 16*a* in the collar 16 are loosened and the sleeve 14 is turned relative to the collar 16 and handle 17 to the proper position for the desired eccentricity or spiral and then tightened. The maximum amount of eccentricity being when handle 17 is in the vertical position and the 270° degree mark on the flange portion 21 of the sleeve 14 is aligned with the index marker 13*a*. The up and down or spiral motion relative to the longitudinal axis of the reamer 40 forms the inwardly spiraled reaming portion 47 resulting in the radius r1 being greater than r2.

CYLINDRICAL MOTION

The grinding fixture may also be set to grind cylindrical shapes. In this setting, the handle 17 is secured to the mounting block 12 by passing the bolt 38 through the handle into the hole 12*a* in the mounting block 12 (FIG. 3. The flange 21 and sleeve 14 may then be disengaged from the spindle 26 by pulling out on the hand grip 37 and holding it out while turning the flange 29 to rotate only the spindle 26 about its longitudinal axis. In this position, all other settings are non-functional.

Having described the settings, relationships, and motions of the components of the fixture 10, the finished reamer surfaces are easily and quickly ground. After making the proper settings as described above, the operator turns on the grinding wheel and rocks the handle 17 back and forth partially about the longitudinal axis of the fixture as the bed of the grinding machine is advanced to feed the fixture and reamer into the grinding wheel W. The handle 17 should be rocked back and forth a distance sufficient to cover the width of the wing 44 in each stroke. This rocking motion causes simultaneous forward and backward motion and spiraling motion of the reamer as the reamer, tilted at 15° to horizontal, is fed horizontally into the grinding wheel, and the edge E of the grinding wheel W will grind the conical reaming surface 47. As the face of the grinding wheel engages the semi-finished shoulder 48, it will grind the non-cutting tripping shoulder to the proper angle relative to the longitudinal axis of the reamer. As the handle 17 is rocked, the forward and rearward motion of the reamer will grind the tripping shoulder 48 such that the spiraled curved reaming portion also extends rearward from a longer distance d1 to a shorter distance d2 from the front surface of the conical portion. In other words, the transition between the angular surfaces 47 and 48 will be closer to the front of the reamer at the trailing edge T than at the leading edge L.

After grinding one wing 44, the fixture 10 is moved rearwardly to clear the grinding wheel W and the reamer 40 is rotated to position the next wing 44 of the reamer with the leading edge L in alignment with the rotational axis of the grinding wheel W. The fixture 10 may be indexed from one wing to the next without changing the eccentric relationship between the spindle 26 and sleeve 14 or any of the other settings. The operator only needs to pull out on the hand grip 37, retracting the rod 35, rotate the spindle 26 on its own axis relative to the sleeve 14, and then release the rod 35 into the next hole 36 making it once again integral with the sleeve 14, whereby both turn on bearings 15. The holes may be While this invention has been described fully and completely with special emphasis upon a preferred embodiment, it should be understood that within the scope of the appended claims the invention may be practiced otherwise than as specifically described herein.

I claim:

1. A fixture for holding and positioning reamers, bits, and the like for grinding and adapted for operation relative to a rotating grinding wheel positionable at selective angles relative to a flat horizontally surface, said fixture comprising:

a support base having a lower portion adapted for connection to a flat horizontal surface and an upper portion positioned at a selective angle relative to the horizontal surface, a longitudinal cylindrical sleeve rotatably mounted on the upper portion of said support base and having an eccentric longitudinal bore and a radial flange portion at its rearward end, a longitudinal cylindrical spindle rotatably received within said sleeve eccentric bore and having a mounting flange at its forward end adapted to receive a chuck for holding the reamer or other object to be ground and a rear flange reassembly secured to the rear end of the spindle adjacent said sleeve radial flange, handle means operatively connected on said sleeve for rotating said sleeve about its longitudinal axis relative to said support base, an axial guide flange operatively connected between said support base and said sleeve and having an upstanding portion positionable at selective angles transverse to the longitudinal axis of said sleeve to simultaneously move said sleeve forward and rearward a selective distance along its longitudinal axis upon rotation of said sleeve, roller means operatively connected with said handle and said sleeve and engageable with said guide flange upstanding portion such that when said handle means is pivoted said sleeve will rotate about its longitudinal axis and said roller means rolling across the angularly transverse positioned upright portion of said guide flange causes said sleeve to move forward or rearward along its longitudinal axis as it rotates, and engagement means operatively connected between said spindle and said sleeve for selectively locking said spindle with said sleeve for rotational movement as a single unit about the longitudinal axis of said sleeve or releasing said spindle from said sleeve for rotating only said spindle about its longitudinal axis relative to said sleeve, said spindle being eccentrically mounted in said sleeve such that the longitudinal axis of said spindle will rotate partially about the centerline of said sleeve when said spindle and said sleeve are locked together whereby the reamer or other object being ground is eccentrically rotated in a radial spiral motion when said handle means is pivoted, and when said axial guide flange upstanding portion is angularly positioned said reamer or other object being ground will move forward or rearward in a radial spiral motion as said handle means is pivoted, and when said spindle and said sleeve are unlocked from one another the reamer or other object being ground may be rotated only about its own longitudinal axis.

2. A fixture according to claim 1 including a series of compression springs contained within circumferentially spaced holes in said spindle rear flange and having pads at one end which are urged outwardly in sliding engagement against the rear surface of said sleeve radial flange portion to resiliently bias said spindle within said sleeve to compensate for wear and insure close tolerance.

3. A fixture according to claim 1 in which said handle means and said roller means extend radially outward relative to said sleeve and are adjustably connected thereto for selective circumferential positioning relative to the longitudinal axis of said sleeve and said spindle, whereby the eccentric position of said spindle relative to said handle means may be selectively controlled.

4. A fixture according to claim 3 in which said handle means comprises a collar adjustably secured by set screws onto the exterior of said sleeve and having a handle member extending radially outwardly from said collar for rotating said sleeve relative to said support base member, and said roller means extends radially outward from said collar to rotatably engage said axial guide flange upstanding portion.

5. A fixture according to claim 4 in which the eccentric position of said spindle relative to said handle is adjusted by positioning said handle vertically and rotating said sleeve relative to said handle to laterally position the longitudinal axis of said spindle at a predetermined distance relative to the vertical axis and securing said collar to said sleeve, whereby said spindle will rotate partially about the centerline of said sleeve when said spindle and said sleeve are locked together whereby the reamer or other object being ground is eccentrically rotated in a radial spiral motion having a predetermined variable radius when said handle is pivoted.

6. A fixture according to claim 5 including index means on said support base and calibrations on said sleeve radial flange portion for indicating the amount of eccentricity of said spindle longitudinal axis relative to said handle.

7. A fixture according to claim 1 including spring means operatively connected between said support base and said sleeve to resiliently urge said roller means into rolling engagement with said guide flange upstanding portion.

8. A fixture according to claim 7 in which said spring means comprises a compression spring having one end connected to said support base and having a pad at the other end which is urged outwardly in sliding engagement against the front surface of said sleeve radial flange portion to resiliently urge said sleeve rearward whereby said roller means is maintained in rolling engagement with said guide flange upstanding portion.

9. A fixture according to claim 1 in which said support base comprises a flat bottom plate adapted for connection to the flat horizontal surface, a pair of rectangular upright plate members one at the forward end and one at the rearward end of said bottom plate, and a rectangular top plate extending between said end plates, said forward end plate being of greater height than the rearward end plate to position the longitudinal axis of said sleeve at an inclined angle relative to the horizontal surface, a pair of upstanding rectangular mounting blocks secured to said top plate at each end of the base, and said cylindrical sleeve is rotatably journaled between said mounting blocks at each end.

10. A fixture according to claim 16 in which said axial guide flange comprises an upstanding guide flange adjustably mounted on said top plate beneath said sleeve and having a bottom plate and an upstanding portion perpendicular thereto with a semi-circular cut-out portion at its top end to clear the bottom exterior surface of said sleeve, said upstanding portion extending transversely across said base, and said bottom plate is adjustably rotatably secured to said top plate to position said upstanding portion at selective angles transverse to the longitudinal axis of said sleeve, whereby when said handle means is pivoted, said sleeve will rotate about its longitudinal axis and said roller means rolling across the angularly transverse positioned upstanding portion of said guide flange will cause said sleeve to move forward or rearward along its longitudinal axis as it rotates, and changing the transverse angle of said guide flange controls the amount of forward and rearward axial travel of said sleeve along its longitudinal axis.

11. A fixture according to claim 1 in which said engagement means includes releasable locking means operatively connected between said spindle rear flange and said sleeve radial flange portion to selectively lock said spindle with said sleeve for rotational movement as a single unit about the longitudinal axis of said sleeve or unlock said spindle from said sleeve for rotating only said spindle about its longitudinal axis relative to said sleeve, and said locking means operative to engage said spindle rear flange with said sleeve radial flange in selective circumferential relation relative to one another without changing the eccentric relationship between said sleeve longitudinal axis and said spindle longitudinal axis such that said spindle may be rotated about its axis while positioned eccentrically within said sleeve for positioning subsequent surfaces of the reamer or other object being ground, whereby the subsequently positioned surfaces will be ground to the same configuration as the previously ground surface.

12. A fixture according to claim 11 in which said sleeve flange portion has a series of circumferentially spaced holes corresponding to the number of surfaces of the reamer or other object to be ground and the spacing of said holes corresponding to the relative angle between said surfaces, and said locking means includes a retractable member carried by said spindle rear flange which is engageable in selective ones of said holes.

13. A fixture according to claim 12 in which said locking means comprises a tubular housing secured on said spindle rear flange, a compression spring contained within said housing, and a retractable rod member urged outwardly by said compression spring into engagement with one of said holes in said sleeve radial flange portion, and a hand grip secured at the other end of said rod for moving it in and out of engagement.

14. A fixture according to claim 12 including index means associated with said holes for indicating the relative angles of the corresponding surfaces of the reamer or other object to be ground.

* * * * *